US009593854B2

(12) United States Patent
Rasi et al.

(10) Patent No.: US 9,593,854 B2
(45) Date of Patent: Mar. 14, 2017

(54) GAS STOVE

(75) Inventors: Fabio Rasi, Forli (IT); Cedric Catalogne, Torreano di Martignacco (IT); Nico Biagioli, Sepolcro-Arezzo (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 378 days.

(21) Appl. No.: 13/641,253

(22) PCT Filed: Jun. 1, 2011

(86) PCT No.: PCT/EP2011/002696
§ 371 (c)(1),
(2), (4) Date: Oct. 15, 2012

(87) PCT Pub. No.: WO2011/160762
PCT Pub. Date: Dec. 29, 2011

(65) Prior Publication Data

US 2013/0087137 A1 Apr. 11, 2013

(30) Foreign Application Priority Data

Jun. 23, 2010 (EP) ..... 10006526

(51) Int. Cl.
*F24C 3/00* (2006.01)
*F24C 15/10* (2006.01)
(Continued)

(52) U.S. Cl.
CPC ..... *F24C 3/085* (2013.01); *F23D 14/06* (2013.01); *F23D 14/58* (2013.01)

(58) Field of Classification Search
CPC ..... F24D 14/06; F24D 14/08; F23D 14/06; F23D 14/08; F24C 3/02; F24C 3/022
(Continued)

(56) References Cited

U.S. PATENT DOCUMENTS 4,690,636 A * 9/1987 Lemonnier de Gouville et al. ..... 431/354
4,773,383 A * 9/1988 Le Monnier de Gouville et al. ..... 126/39 R
(Continued)

FOREIGN PATENT DOCUMENTS

DE 3123751 12/1982
DE 19813691 6/1999
(Continued)

OTHER PUBLICATIONS

International Search Report for PCT/EP2011/002696, dated Aug. 4, 2011, 3 pages.

*Primary Examiner* — Avinash Savani
*Assistant Examiner* — Vivek Shirsat
(74) *Attorney, Agent, or Firm* — Pearne & Gordon LLP

(57) ABSTRACT

A gas stove having an upper work plate with at least one integrated gas burner, said gas burner including a bowl-shaped base body, a burner crown, and an upper cap, with several flame ports provided to let out a gas-air mixture towards a recipient to be heated, and an annular mixing zone, whose cross section incrementally expands towards the flame ports, defined between the burner crown and the upper cap with the burner crown including a Venturi pipe which feeds the gas-air mixture into the mixing zone and is designed to suck primary air from above the upper work plate the flame ports are formed in the upper cap as through-holes, and the bottom side of the upper cap, which defines the upper side of the mixing zone, is at least partially inclined upwardly towards the flame ports to define the incrementally expanding cross section of the mixing zone.

7 Claims, 2 Drawing Sheets

(51) Int. Cl.

| | |
|---|---|
| ***F24C 3/08*** | (2006.01) |
| ***F23D 14/06*** | (2006.01) |
| ***F23D 14/58*** | (2006.01) |

(58) Field of Classification Search
USPC ..... 126/39 E, 39 H, 39 R
See application file for complete search history.

(56) References Cited

U.S. PATENT DOCUMENTS

| | | | | |
|---|---|---|---|---|
| 6,067,978 | A * | 5/2000 | Schlosser | F23D 14/06 126/39 E |
| 6,135,764 | A * | 10/2000 | Kwiatek | 431/266 |
| 8,381,714 | B2 * | 2/2013 | Shaffer | F23D 14/06 126/39 E |
| 2003/0075164 | A1 * | 4/2003 | Dane | 126/39 R |
| 2007/0059654 | A1 * | 3/2007 | Armanni | 431/8 |
| 2009/0078247 | A1 * | 3/2009 | Sun | 126/39 R |

FOREIGN PATENT DOCUMENTS

| | | |
|---|---|---|
| EP | 0797048 | 9/1997 |
| EP | 2290287 | 3/2011 |
| GB | 2190483 | 11/1987 |

* cited by examiner

GAS STOVE

The present invention relates to a gas stove having an upper work plate with at least one integrated gas burner, said gas burner comprising a bowl-shaped base body, a burner crown arranged on the base body, and an upper cap arranged on the burner crown, wherein several flame ports are provided to let out a gas-air mixture towards a recipient to be heated, and wherein an annular mixing zone, whose cross section incrementally expands towards the flame ports, is defined between the burner crown and the upper cap.

BACKGROUND

A gas stove of the above-mentioned kind is known for example from EP-A-1 898 153. This gas stove comprises one or more gas burners, each being formed by a bowl-shaped base body, a burner crown arranged on the base body, and an upper cap arranged on the burner crown. The burner crown is provided on its circumference with a plurality of flame ports to let the gas-air-mixture go out in a radial direction and essentially in parallel to the bottom of the recipient to be heated. The upper cap closes the burner top and defines the flame ports together with the burner crown. An annular mixing zone is provided between the burner crown and the upper cap. The cross section of the mixing zone incrementally expands towards the flame ports. The mixing zone is defined by a planar horizontal bottom side of the upper cap and by an annular recess formed at the top side of the burner crown, wherein the depth of the annular recess incrementally increases in a radial direction towards the flame ports.

One major drawback of the described gas burner construction is that a lot of heat is released to the environment by the flames produced by such flame ports letting the gas-air-mixture go out in a radial direction. Accordingly, the efficiency of the gas burner is low. Moreover, the heat released to the environment may negatively effect the lifetime of the appliance or the colour of the work plate to which the gas burner is fixed, or the like.

SUMMARY

It is an object of the present invention to provide a gas stove equipped with the gas burner of the above-mentioned kind with a good efficiency. Moreover, it is an object of the present invention to provide a gas burner of the above-mentioned kind, whose flames do not negatively effect the lifetime or the appearance of the appliance. Furthermore, an adequate air entrainment is to be assured.

In order to solve this object the present invention provides a gas burner of the above-mentioned kind, which is characterized in that the burner crown is provided with a Venturi pipe, which feeds the gas-air mixture into the mixing zone and is designed to suck primary air from above the upper work plate, in that the flame ports are formed in the upper cap as through-holes, and in that the bottom side of the upper cap, which defines the upper side of the mixing zone, is at least partially inclined upwardly towards the flame ports with respect to the horizontal in order to define the incrementally expanding cross section of the mixing zone.

Due to the fact that the flame ports are formed as through-holes provided in the upper cap, the gas-air-mixture or rather the flames leave the flame ports in an upward direction directly towards the recipient to be heated. Accordingly, only very few heat is released to the environment such that no derogations of the lifetime or the appearance of the appliance are to be expected. Moreover, due to the little heat loss the efficiency of the burner is high. Furthermore, the flame ports are oriented towards the upcoming flow of the gas-air mixture, whereby turbulences within the mixing zone are at least partially prevented.

However, applicants have recognized, that the provision of the flame ports in the upper cap leads to a shortening of the distance between the flame ports an the recipient to be heated and thus to a reduction of the length of the flames compared to the design, where the flame ports are arranged sideways at the circumference of the burner crown. As a consequence, the amount of secondary air entrained by the flames is substantially reduced, compromising the combustion results.

The most obvious solution to counter this lack of secondary air would be to increase the distance between the burner and the recipient to be heated. However, this would at least partially jeopardize the improved thermal efficiency mentioned before.

Therefore, the present invention counters the lack of secondary air with an increased amount of primary air, recovering the combustion performances. This increased amount of primary air is gained by means of a special design of the mixing zone, where the bottom side of the upper cap, which defines the upper side of the mixing zone, is at least partially inclined upwardly towards the flame ports with respect to the horizontal in order to define the incrementally expanding cross section of the mixing zone. This design achieves a very good primary air entrainment, because the creation of unnecessary turbulences in the flame ports is further eliminated due to the fact that the design of the mixing zone is adjusted to the flow direction of the incoming gas-air mixture. Moreover, the primary air is sucked from above the upper work plate. Therefore, an endless reservoir of primary air is available.

Preferably, the upper side of the burner crown, which defines the bottom side of the mixing zone, extends with a maximum angle of 10° with respect to the horizontal. In this manner an optimal adjustment of the mixing zone with respect to the flow direction of the incoming gas-air mixture can be achieved.

According to one aspect of the present invention, the bottom side of the upper cap is formed with an annular recess whose depth increases in a radial direction towards the flame ports.

According to a further aspect of the present invention the flame ports are inclined with respect to the vertical by an angle of at least 15°, preferably by an angle of about 45°. This also contributes to a reduction of turbulences in the flame ports and thus to a good primary air entrainment.

Preferably, the flame ports extend at right angle from a surface of the annular recess provided at the bottom side of the upper cap. Accordingly, the drilling process for producing the through-holes is simplified since now an orthogonal surface is provided for positioning the drilling tool. This enhances the quality of the drilling operations and reduces the operational time as well as the scrap.

Advantageously, the inclination of the flame ports is essentially aligned with the flow direction of the gas-air mixture directly ahead of the flame ports, i.e. immediately before the gas-air mixture enters the flame ports. This also contributes to the prevention of turbulences within the mixing zone.

According to one aspect of the present invention the Venturi pipe is designed to suck primary air exclusively from above the upper work plate. With this design very good results were achieved.

BRIEF DESCRIPTION OF THE DRAWINGS

Further features and advantages of the present invention will become apparent by means of the following description of a preferred embodiment of an inventive gas stove with reference to the accompanying drawing. In the drawing

DETAILED DESCRIPTION

Figure 1:
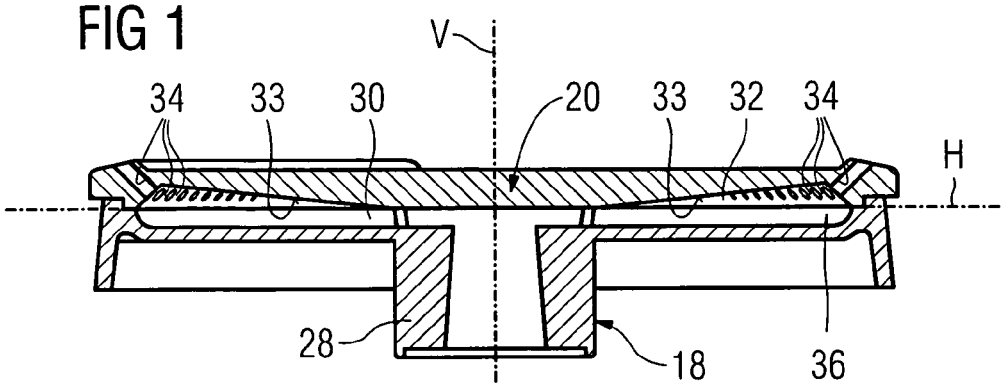
FIG. 1 is a cross section view of a burner crown and an upper cap of gas burner of gas stove according to an embodiment of the present invention.
Figure 2:
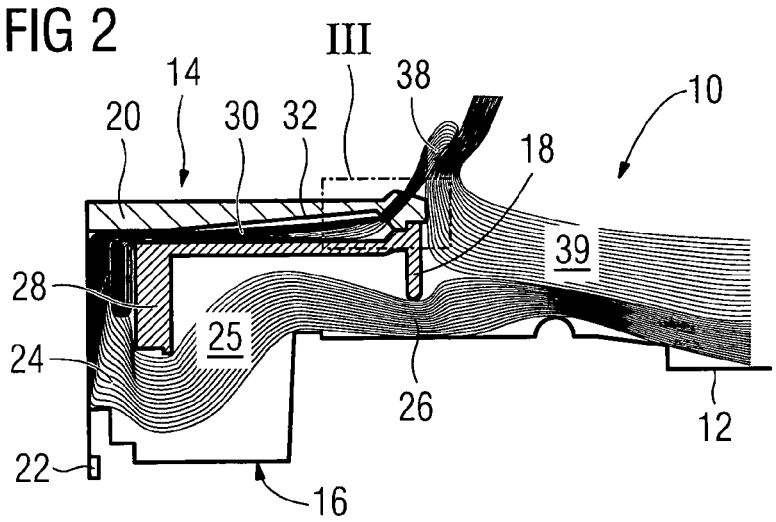
FIG. 2 is a schematic view of the arrangement shown in FIG. 1, which illustrates the flow distribution of gas, primary air and secondary air during the operation of the burner.
Figure 3:
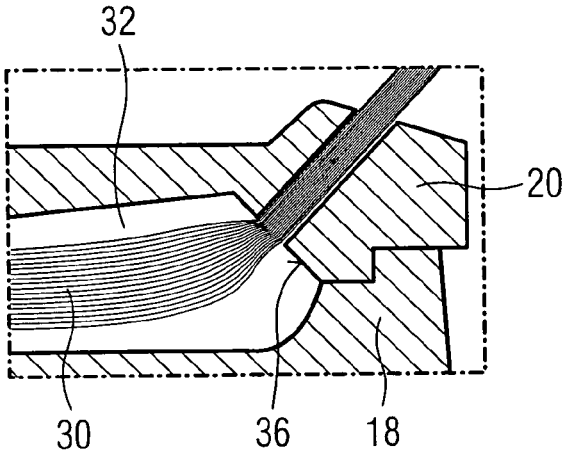
FIG. 3 is an enlarged view of detail III in FIG. 2.

FIGS. 1 to 3 show components of a gas stove 10 according to an embodiment of the present invention. The gas stove 10 has an upper work plate 12 with an integrated gas burner 14. The gas burner 14 comprises a bowl-shaped base body 16, which is not shown in further detail, a burner crown 18 arranged on the base body 16, and an upper cap 20 arranged on the burner crown 18.

The base body 16 of the gas burner 14 is received in the upper work plate 12 of the gas stove 10 and comprises in its lower portion an injector 22, which is connected to a gas supplying pipe. The injector 22 projects into a chamber 24, which is defined between the base body 16 and the burner crown 18 and which is provided with several inlets 26 through which ambient air from above the upper work plate 12 is entrained into the chamber 24 as primary air 25.

The burner crown 18, which is arranged on top of the bowl-shaped base body 16, comprises a Venturi pipe 28, which projects into the chamber 24 and is positioned vertically above the injector 22. The Venturi pipe 28 leads into an annular mixing zone 30, which is formed between the burner crown 18 and the upper cap 20 and whose cross section or perimeter section expands radially outwards from the Venturi pipe 28.

The upper cap 20 is formed at its bottom side with an annular recess 32, whose main surface 33 is upwardly inclined with respect to the horizontal H such that the depth of the recess 32 incrementally increases radially outwards in order to create the incrementally outwards expanding cross section of the mixing zone 30. On the contrary, the upper surface of the burner crown 18 extends with a maximum angle of 10° with respect to the horizontal H. In the area of the outer perimeter of the annular recess 32 the upper cap 20 is provided with a plurality of flame ports 34, which are inclined with respect to the vertical V by an angle of at least 30°, preferably about 45°. The flame ports 34 are annularly arranged, whereas each flame port 34 is provided as a through-hole leading from the mixing zone 30 to the upper side of the upper cap 20. The surface 36 of the annular recess 32, from which the flame ports 34 extend, is arranged at right angle with respect to the flame ports 34. Accordingly, the drilling process for producing the through-holes is simplified since an orthogonal surface is provided for positioning the drilling tool. This enhances the quality of the drilling operations and reduces the operational time as well as the scrap.

During the operation of the gas burner 14 the gas is supplied to the injector 22 through a gas supplying pipe. The injector 22 injects the gas into the mixing zone 30 via the chamber 24 and the Venturi pipe 28. Within the chamber 24 ambient air is sucked as primary air 25 exclusively from above the upper work plate 12 through the inlets 26 and then flows through the Venturi pipe 28 into the mixing zone 30, where the gas-air-mixture is mixed. Due to the incrementally expanding cross section of the mixing zone 30, the pressure of the gas-air mixture is increased and its velocity is reduced until the gas-air-mixture reaches the flame ports 34. The gas-air-mixture leaves the gas burner 14 through the flame ports 34. The flames 38, which are created above the flame ports 34 and are directed towards the recipient to be heated, entrain secondary air 39.

Due to the fact that the flame ports 34 are directed towards the recipient to be heated, most of the heat is transferred to the recipient. Thus, the efficiency of the gas burner 14 is very high. Furthermore, very little heat is released into the environment. Accordingly, no damage of other components, such as a degradation of the colour of the upper work plate 12 of the gas stove 10, is to be expected. Furthermore, since the flame ports 34 are inclined with respect to the vertical V by an angle of at least 30°, preferably about 45°, they are aligned with the flow direction of the gas-air mixture directly ahead of the flame ports 34, such that the discharge of the gas-air mixture in the environment is facilitated. This leads to an improvement of the fluid dynamics of the burner 14.

Figure 4:
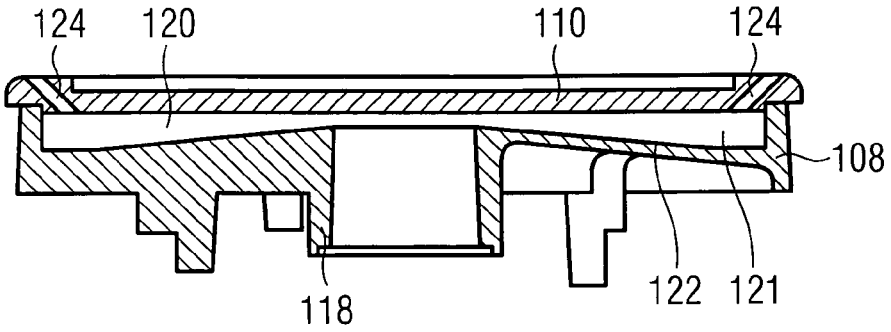
FIG. 4 is a cross section view of a burner crown and an upper cap of a comparative gas burner.

Moreover, thanks to the special design of the mixing zone 30, in particular thanks to the fact that the expanding cross section of the mixing zone 30 is predominantly realized by the inclination of the bottom side of the upper cap 20 with respect to the horizontal and that the flame ports 34 are oriented towards the upcoming flow of the gas-air mixture, the designs of the mixing zone 30 and of the flame ports 34 are optimally adjusted to the flow direction of the gas-air mixture entering the mixing-zone 30. Accordingly, turbulences within the mixing zone 30 are prevented and a very good primary air entrainment is achieved. In order to illustrate this advantageous primary air entrainment, a comparative example of a gas stove 100 is shown throughout FIGS. 4 to 6.

The gas stove 100 has an upper work plate 102 with an integrated gas burner 104. The gas burner 104 comprises a bowl-shaped base body 106, a burner crown 108 arranged on the base body 106, and an upper cap 110 arranged on the burner crown 108.

The base body 106 of the gas burner 104 is received in the upper work plate 102 of the gas stove 100 and comprises in its lower portion an injector 112, which is connected to a gas supplying pipe. The injector 112 projects into a chamber 114, which is defined between the base body 106 and the burner crown 108 and which is provided with several inlets 116 through which ambient air from above the upper work plate 102 is supplied into the chamber 114 as primary air 115.

The burner crown 108, which is arranged on top of the bowl-shaped base body 106, comprises a Venturi pipe 118, which projects into the chamber 114 and is positioned vertically above the injector 112. The Venturi pipe 118 leads into an annular mixing zone 120, which is formed between the burner crown 108 and the upper cap 110 and whose cross section or perimeter section expands radially outwards from the Venturi pipe 118. The burner crown 108 is formed at its upper side with an annular recess 122, whose depth incrementally increases radially outwards in order to create the incrementally outwards expanding cross section of the mixing zone 120. The mixing zone 120 passes into a steady zone 121, which is defined by the burner crown 108 and the upper cap 110 and has a constant cross section or perimeter section in the radial direction.

The upper cap 110 has a planar bottom side. In the area of its outer diameter the upper cap 110 is provided with a plurality of annularly arranged flame ports 124, which are slanted with respect to the vertical by an angle of at least 30°, preferably about 45°. The flame ports 124 are formed as through-holes leading from the steady zone 121 to the upper side of the upper cap 110.

During the operation of the gas burner 104 the gas is supplied to the injector 112 through a gas supplying pipe. The injector 112 injects the gas into the mixing zone 120 via the chamber 114 and the Venturi pipe 118. Within the chamber 114 the ambient air is sucked as primary air 115 from above the upper work plate 102 through the inlets 116 and then flows through the Venturi pipe 118 into the mixing zone 120, where the gas-air-mixture is mixed. Due to the incrementally expanding cross section of the mixing zone 120, the pressure and the velocity of the gas-air-mixture are reduced until the gas-air-mixture reaches the steady zone 121. Within the steady zone 121 the pressure and the velocity of the gas-air mixture are kept constant in order to distribute the mixture evenly across the flame ports 124. The gas-air-mixture leaves the gas burner 104 through the flame ports 124. The flames 128, which are created above the flame ports 124 and are directed towards the recipient to be heated, entrain secondary air 129.

Figure 5:
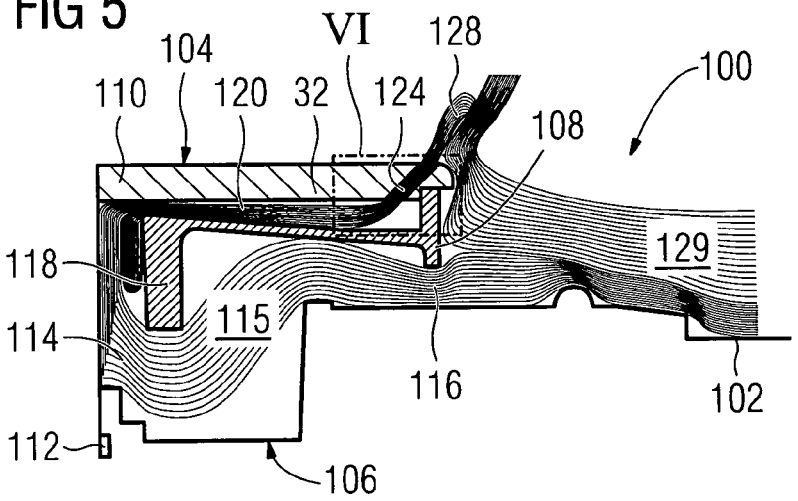
FIG. 5 is a schematic view of the arrangement shown in FIG. 4, which illustrates the flow distribution of gas, primary air and secondary air during operation.
Figure 6:
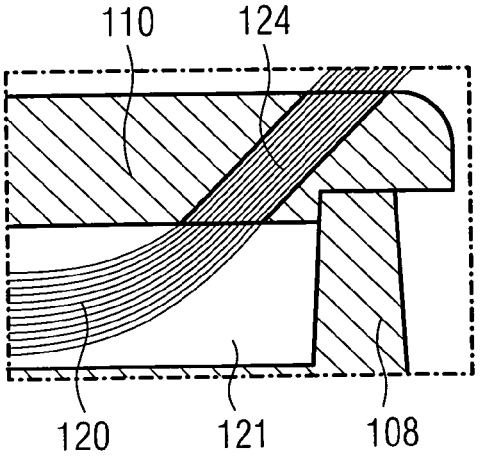
FIG. 6 is an enlarged view of detail VI in FIG. 5.

As can be seen by means of a comparison of FIGS. 2 and 5 or of FIGS. 3 and 6, the entrainment of primary air of the gas burner 14 is much better than the one of the gas burner 104. Applicants have recognized that moving the recess with the incrementally increasing depth from the upper side of the burner crown, as it is shown throughout FIGS. 4 to 6, to the bottom side of the upper cap, as it is illustrated in FIGS. 1 to 3, leads to a gain in primary air entrainment of about 10 to 20%. This improvement was calculated with a Computational Fluid Dynamics Analysis.

The invention claimed is:

1. A gas stove having an upper work plate with at least one integrated gas burner, said gas burner comprising:

a bowl-shaped base body;

a burner crown arranged on the base body; and an upper cap arranged on the burner crown, wherein a plurality of flame ports are provided to let out a gas-air mixture towards a recipient to be heated, and wherein an annular mixing zone, whose cross section incrementally expands towards the flame ports, is defined between the burner crown and the upper cap, wherein the burner crown is provided with a Venturi pipe which feeds the gas-air mixture into the mixing zone and is designed to suck primary air from above the upper work plate, wherein the plurality of flame ports are formed in a top surface of the upper cap as through-holes, and wherein a bottom side of the upper cap defines an upper side of the mixing zone, wherein the bottom side of the upper cap is at least partially inclined upwardly towards the flame ports with respect to the horizontal to define the incrementally expanding cross section of the mixing zone, and wherein an upper side of the burner crown defines a bottom side of the mixing zone, and wherein the upper side of the burner crown extends continuously between a center of the burner and the flame ports with a maximum angle of 10 degrees with respect to horizontal, and wherein each of the plurality of flame ports is inclined with respect to the vertical by an angle of at least 15°, and extends away from a vertical central axis of the burner crown and wherein the bottom side of the upper cap comprises an annular recess whose depth increases in a radial direction towards the flame ports, and wherein the plurality of flame ports extends at a right angle from a surface of the annular recess, and away from a vertical central axis of the burner crown.

2. The gas stove according to claim 1, wherein an inclination of each of the plurality of flame ports is essentially aligned with a flow direction of the gas-air mixture directly ahead of the plurality of flame ports.

3. The gas stove according to claim 1, wherein the Venturi pipe is designed to suck primary air from above the upper work plate through an inlet between the burner crown and the upper work plate.

4. The gas stove according to claim 1, wherein the Venturi pipe is designed to suck primary air exclusively from above the work plate through the inlet between the burner crown and the upper work plate.

5. The gas stove according to claim 1, wherein each of the plurality of flame ports is inclined with respect to the vertical by an angle of about 45°.

6. The gas stove according to claim 1, wherein the top surface of the upper cap comprises a center top surface arranged in a center of the upper cap and an outer top surface arranged at an outer portion of the upper cap, and wherein the plurality of flame ports are arranged around the top surface of the upper cap between the center top surface and the outer top surface.

7. The gas stove according to claim 1, wherein the surface of the annular recess where the plurality of flame ports are located, extends downward with respect to the horizontal.

* * * * *